US006926593B1

(12) United States Patent
Carroll et al.

(10) Patent No.: US 6,926,593 B1
(45) Date of Patent: Aug. 9, 2005

(54) VEHICLE WHEEL HOLE DEBURRING DEVICE AND METHOD

(75) Inventors: Jeremy Carroll, Charlotte, MI (US); Geoffrey L. Gatton, Farmington, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 14 days.

(21) Appl. No.: 10/837,954

(22) Filed: May 3, 2004

(51) Int. Cl.[7] ..... B24B 9/00

(52) U.S. Cl. ..... 451/65; 451/66; 451/71; 451/358; 451/367; 451/375

(58) Field of Search ..... 451/65, 66, 71, 451/358, 360, 365, 367, 375

(56) References Cited

U.S. PATENT DOCUMENTS 647,981 A * 4/1900 McMackin ..... 451/349
4,245,366 A 1/1981 Arnal
4,301,567 A 11/1981 Tucker
4,426,747 A 1/1984 Mola et al.
4,467,489 A 8/1984 Begneaud
5,131,110 A 7/1992 Hadgis
5,520,569 A * 5/1996 Endoh ..... 451/5
5,530,985 A 7/1996 Tsai et al.
5,897,273 A 4/1999 Barbosa Leite
5,967,887 A * 10/1999 Synowski ..... 451/358
6,019,555 A 2/2000 Sadoski
6,173,470 B1 1/2001 van Osenbruggen
6,393,645 B1 * 5/2002 Kadinger ..... 15/104.04
6,533,505 B1 3/2003 Robinson
6,702,656 B1 * 3/2004 Hibbert ..... 451/120

* cited by examiner

*Primary Examiner*—Eileen P. Morgan
(74) *Attorney, Agent, or Firm*—MacMillan, Sobanski & Todd, LLC

(57) ABSTRACT

A combined tool for both drilling a hole through a vehicle wheel and deburring the edge of the hole and a method for using the combined tool.

22 Claims, 8 Drawing Sheets

VEHICLE WHEEL HOLE DEBURRING DEVICE AND METHOD

BACKGROUND OF THE INVENTION

This invention relates in general to the manufacture of vehicle wheels and in particular to a device and method for deburring the ends of vehicle wheel holes.

Vehicle wheels include an annular wheel rim that supports a pneumatic tire. A wheel disc formed having a pleasing esthetic shape extends across the outboard end of the wheel rim. The wheel disc usually includes a central hub supported within the rim by a plurality of radially extending spokes. Apertures formed through the wheel hub allow attachment of the wheel to an end of a vehicle axle. Additionally, an aperture formed through a sidewall of the outboard end of the wheel receives a valve stem that is used to inflate the tire mounted upon the wheel rim.

Light weight vehicle wheels cast from alloys of aluminum, magnesium and titanium have become increasingly popular. Such wheels may be cast as one piece upon an automated casting machine. The wheel castings are then finished on machining stations that typically perform multiple machining operations. Thus, the wheel rim is turned to a final shape on a wheel lathe which also can be used to face the outboard surface of the wheel disc. The apertures in the wheel hub and the valve stem hole are drilled while the wheel is mounted upon a wheel hole drilling station. Alternately, the wheels may be assembled from several components that are first machined to final dimensions. Regardless of the method used, the manufacture of vehicle wheels is highly automated.

Referring to the drawings, there is illustrated in FIG. 1 a flowchart for a known method 10 for drilling holes through a vehicle wheel hub. The method 10 begins in functional block 20 with provision of a machining station for drilling wheel holes. Typically, the machining station is a Computer Numerical Control (CNC) machining station. The machining station is used to drill and finish a plurality of holes in a vehicle wheel and typically includes an automated drill head carrying multiple tools, which are indexed into drilling position as needed. For example, one set of tools may be used to form a valve stem hole. The tools would include a drill bit for forming a hole through the wheel sidewall, a counterbore for enlarging a portion of the drilled hole and a countersink for finishing the end of the hole at the bottom of the counterbore. Additionally, the machining station includes a clamping mechanism that holds the wheel and is movable to orient the wheel relative to the drill head. The method 10 then proceeds to functional block 25.

In functional block 25, a wheel casting is mounted upon the machining station clamping mechanism with the outboard wheel surface facing the automated drill head. The method 10 then proceeds to functional block 30. In functional block 30, the wheel is positioned for machining. For machining a valve stem hole in the wheel, the clamping mechanism orients the wheel with the wheel axis forming an angle relative to the tool axis. For machining a lug hole, the wheel is oriented with the wheel axis parallel to the tool axis. Preferably, the positioning is controlled by a program stored within the CNC machine.

In functional block 35, the wheel is drilled, for example, the valve stem hole drill bit may be rotated and advanced to form a valve stem hole. Preferably, the drilling is controlled by programming the CNC machining station. The method 10 then proceeds to functional block 40.

In functional block 40, the tool(s) for machining the wheel are withdrawn. In the case of machining a valve stem hole, for example, the valve stem hole drill bit is retracted. Preferably, the withdrawal is controlled by programming the CNC machine. For a valve stem hole, the drill head is indexed to present another tool to the wheel surface and the operations in functional blocks 35 and 40 are repeated as needed to fully form the hole. Thus, the drill head is indexed to align a counterbore tool with the hole axis and the method proceeds to rotate and advance the counterbore tool to form the counterbore. Then the drill head is indexed to align a countesink with hole axis and the method proceeds to rotate and advance the countersink tool to countersink the end of the hole in the base of the counterbore. After each machining operation, the tool is withdrawn. Once a hole is completed, the method 10 proceeds to decision block 42.

In decision block 42, the method 10 determines whether all of the needed holes have been drilled in the wheel casting. If the drilling operations are not completed, the method transfers to functional block 44 where the drill head is indexed. The operation in functional block 44 is shown as being optional because the same drill may be used again where multiple holes need to be drilled, as in the cast of the lug holes. The method 10 then returns to functional block 30 where the wheel is repositioned for the next drilling operation. If, in decision block 42, the method 10 determines that all of the drilling operations are completed, the method transfers to functional block 45 where the wheel is removed from the machining station. The method 10 then proceeds to functional block 50.

In functional block 50, any burrs that were formed along the edges of the holes during the drilling operations are manually scraped from the edges of the holes by hand with a knife blade.

The known method 10 is susceptible to non-uniformity as the hand scraping technique may vary from person to person when deburring the holes, or even by a single person from time to time. Further, the known method 10 is susceptible to holes not being deburred due to human oversight. In addition, the known method 10 requires a significant number of work hours to manually debur the valve stem hole edge. Accordingly, it would be desirable to automate the deburring process. It is believed that such automation would increase the uniformity and the overall quality of the wheels while reducing the number of labor hours required to the manufacture each vehicle wheel.

BRIEF SUMMARY OF THE INVENTION

This invention relates to a device and a method for deburring the ends of holes formed in a vehicle wheel.

The present invention contemplates a device for smoothing the edge of recess formed in a surface of wheel that includes an abrasive wheel mounted upon a rotating tool shank. In the preferred embodiment, the abrasive wheel includes a plurality of wire bristles and the rotating tool is a drill bit.

The present invention also contemplates a method for machining a vehicle wheel that utilizes the device described above. The method includes forming a recess in the wheel with the rotating tool. The wheel is then repositioned relative to the tool and the edge of the recess is smoothed with the abrasive wheel. In the preferred embodiment, the recess machined in the wheel is a valve stem hole that extends through the wheel.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
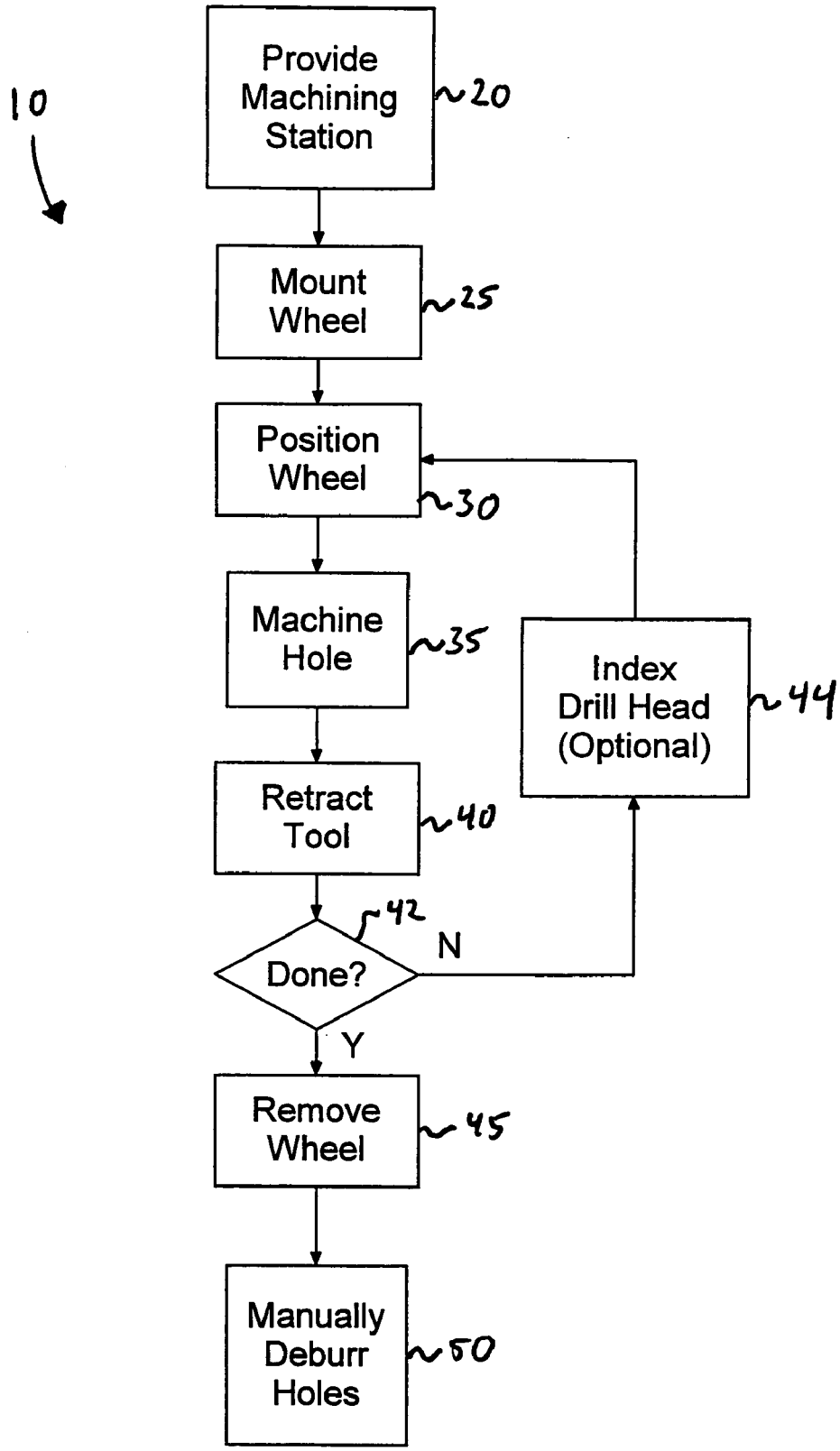
Fig. 1 (Prior Art)
FIG. 1 is a flow chart illustrating a known method for drilling holes in a vehicle wheel.
Figure 2:
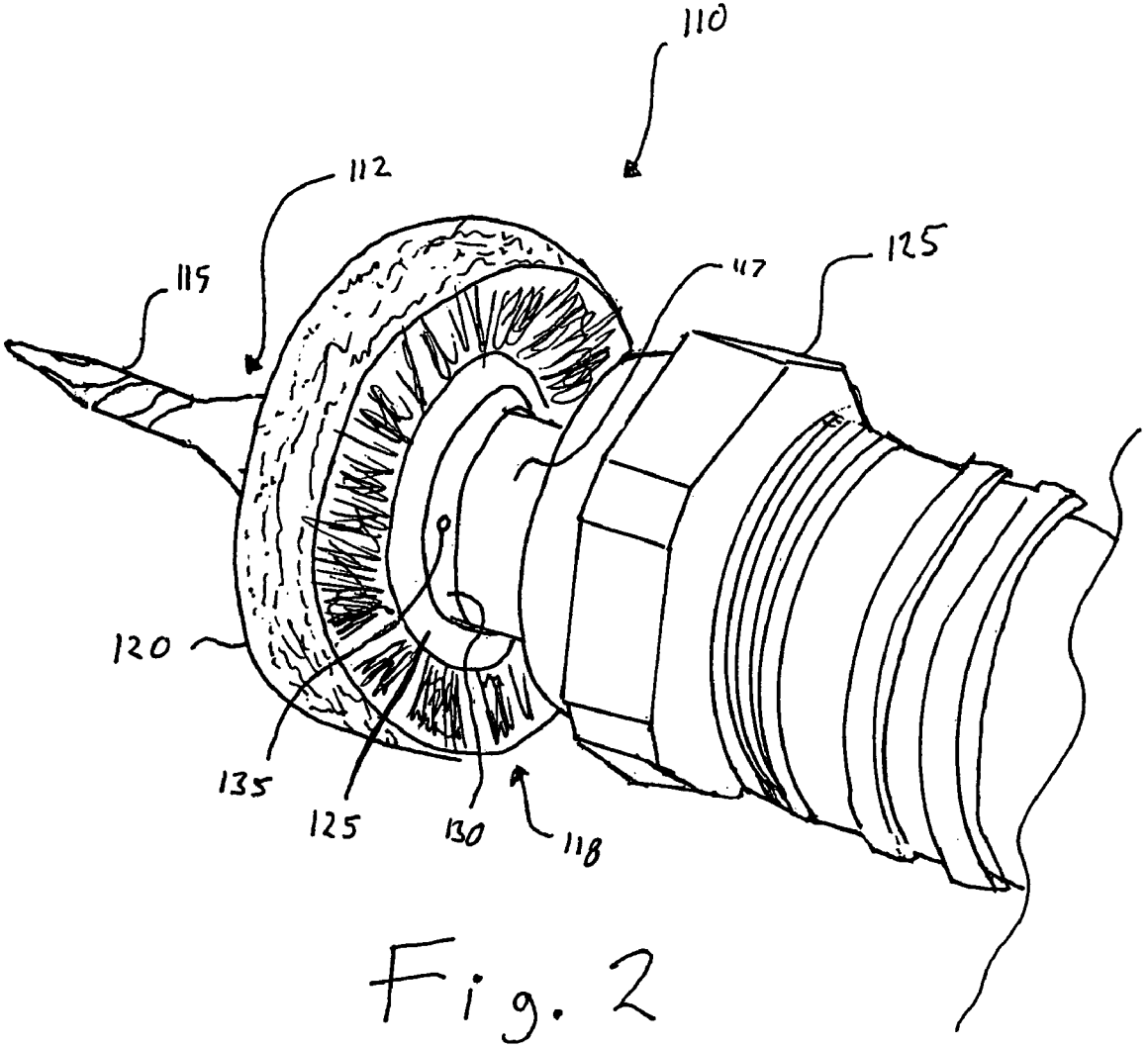
FIG. 2 is a side perspective view of a device for deburring the edge of a vehicle wheel hole in accordance with the present invention.
Figure 3:
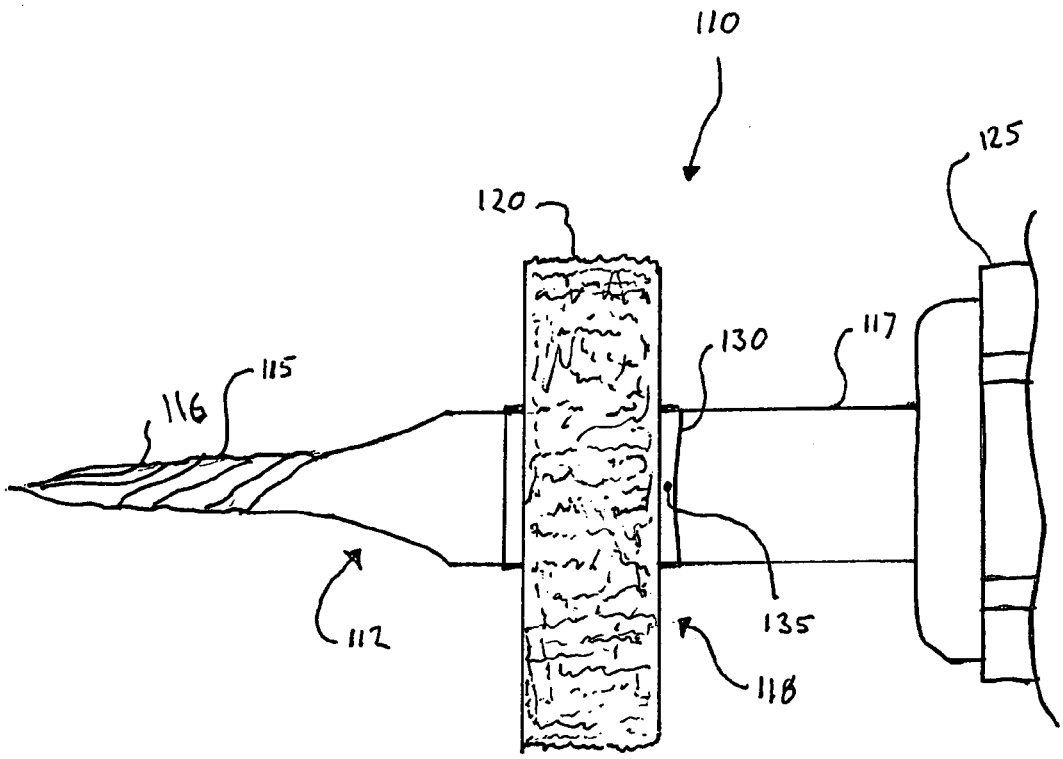
FIG. 3 is a side view of the device of FIG. 2.
Figure 4:
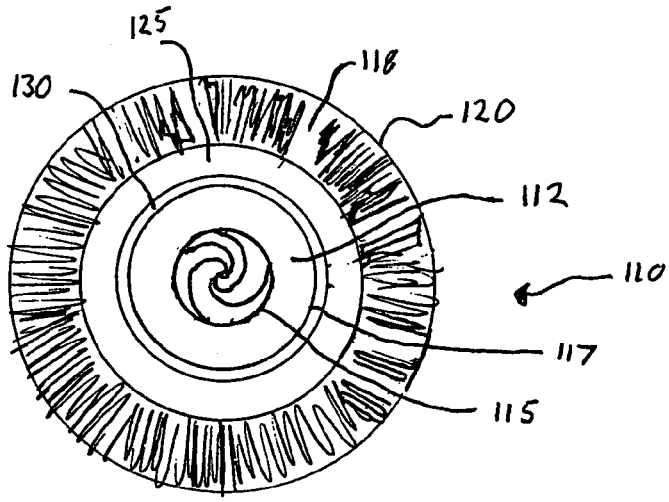
FIG. 4 is an end view of the device of FIG. 2.

Referring again to the drawings, there is illustrated in FIGS. 2 through 4, an improved vehicle wheel drill 110, that is in accordance with the present invention. While the preferred embodiment is used to drill valve stem holes, it will be appreciated that similar drills may be utilized to drill other holes through a vehicle wheel, such as, for example, lug holes.

The drill 110 includes a conventional drill bit 112. The drill bit 112 has a first portion 115 that is to the left of FIG. 3 and is formed with a plurality of conventional cutting flutes 116. The drill bit 112 has a second portion 117 that is to the right of FIG. 3 and is formed as a cylindrical shank. The drill 110 also includes a generally disc-shaped abrasive wheel 118. The abrasive wheel 118 includes an outer abrasive ring 120. In the preferred embodiment, the abrasive ring 120 includes a plurality of wire bristles extending radially outward from the center thereof. Thus, the abrasive wheel 118 is similar to a wire brush wheel. However, the abrasive ring 120 also may be of any other suitable material, such as an abrasive stone, for example. Alternately, the bristles may be formed from other materials than wire.

As best seen in FIG. 4, the abrasive wheel 118 also includes a pair of disc shaped inner flanges 125 (one shown). The flanges 125 hold the abrasive ring 120 in a compressive arrangement. Preferably, the each of the flanges 125 is formed from a metal disc with an aperture punched thorough the center. The flanges 125 are pressed together over the inner ends of the wire bristles and secured to one another with fasteners, such as rivets, or crimped over the bristle ends. Adhesive may be spread over the inner ends of the bristles to secure the bristles to one another and between the flanges 125.

The abrasive wheel 118 further includes a mounting collar 130 disposed within the flange apertures and secured to the flanges 125 by a conventional method, such as crimping, adhesive or spot welding. The collar 130 is shaped as a hollow cylinder with the cylinder perpendicular to disc of the abrasive wheel 118. In the preferred embodiment, a threaded aperture that receives a threaded fastener 135, such as, for example, a set screw, is formed through the mounting collar 130. The drill bit 112 extends through the mounting collar 130 and the threaded fastener 135 secures the abrasive wheel 118 upon the drill bit shank 117. The use of a set screw allows removal and replacement of the abrasive wheel 118 as the bristles become excessively worn. Alternately, the wheel 118 may be removed to facilitate sharpening the drill bit 112.

Alternatively, the inner surface of the mounting collar 130 and outer surface of the shank 117 may be threaded and the abrasive wheel 118 may be secured to the drill bit 112 by screwing the abrasive wheel 118 onto the drill bit shank 117, in which case the fastener 135 would not be necessary. Additionally, the collar 130 may be omitted and the abrasive wheel secured upon the threaded drill bit shank 117 with a pair of threaded nuts (not shown). However, it will be appreciated that the invention also may be practiced with the abrasive wheel 118 permanently mounted upon the drill bit 115 with a rivet or spot weld securing the collar 130 to the drill bit shank 117. In this latter embodiment, the fastener would be omitted.

While the invention has been illustrated and described as an abrasive wheel mounted upon a drill bit, it will be appreciated that the invention also may be practiced with the abrasive wheel mounted upon the shank of another rotating tool. For example, the abrasive wheel also may be mounted upon a counterbore, a countersink (not shown) or another tool that is mounted upon the machining station drill head.

Figure 5:
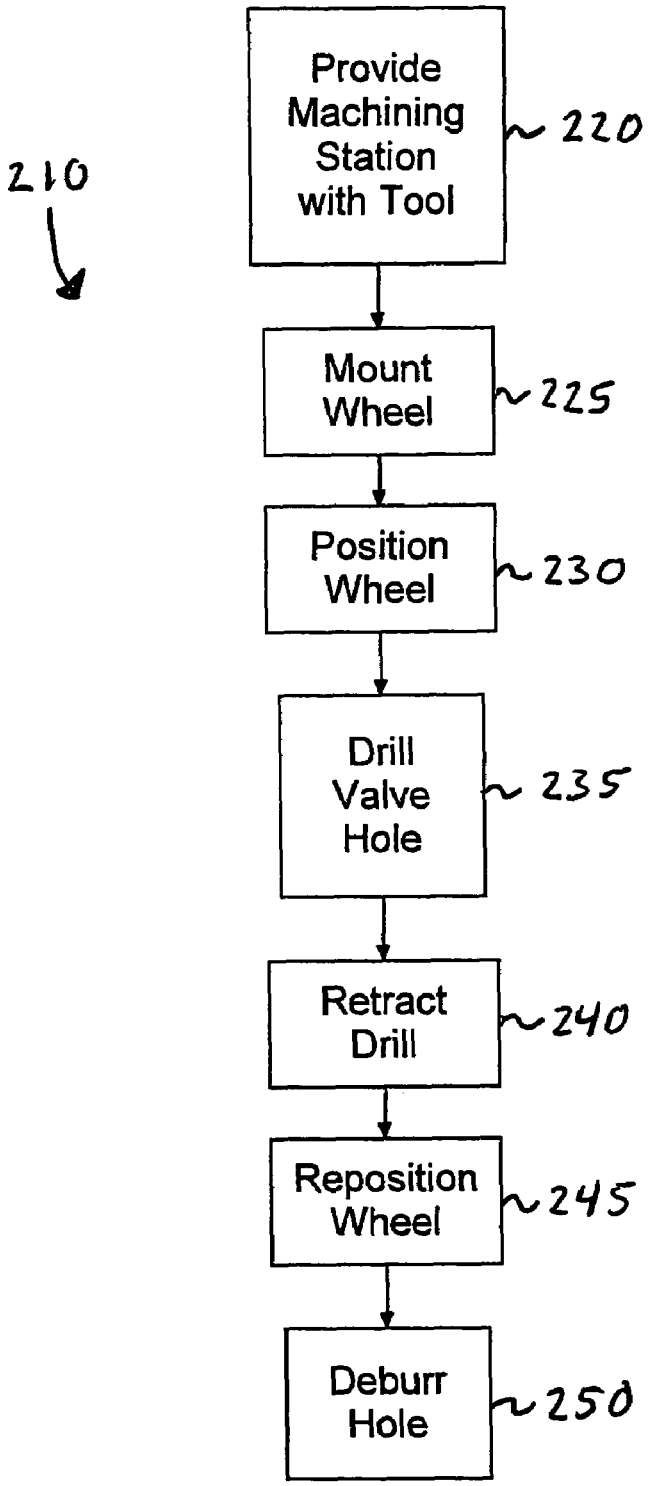
FIG. 5 is a flow chart illustrating a method for drilling a hole in a vehicle wheel in accordance with the invention and that utilizes the device shown in FIG. 2.

The present invention also contemplates a method 210 for machining and deburring holes formed in a vehicle wheel, such as a valve stem hole, that utilizes the device shown in FIG. 2. The method 210 is illustrated by the flow chart shown in FIG. 5. The method 210 begins in functional block 220 with provision of a machining station for drilling holes through a vehicle wheel hub and preferably includes an automated drill head carrying multiple tools, as needed. One tool, for example may be the valve stem hole drill 110 described above. The machining station also includes a clamping mechanism (not shown) that holds the wheel and is movable to orient the wheel relative to the drill head. Preferably, the machining station is a Computer Numerical Control (CNC) machining station. The method 210 then proceeds to functional block 225 where a wheel 226 is mounted upon the machining station, or wheel drilling machine, with the outboard wheel surface facing the automated drill head. The method 210 then proceeds to functional block 230.

Figure 6B:
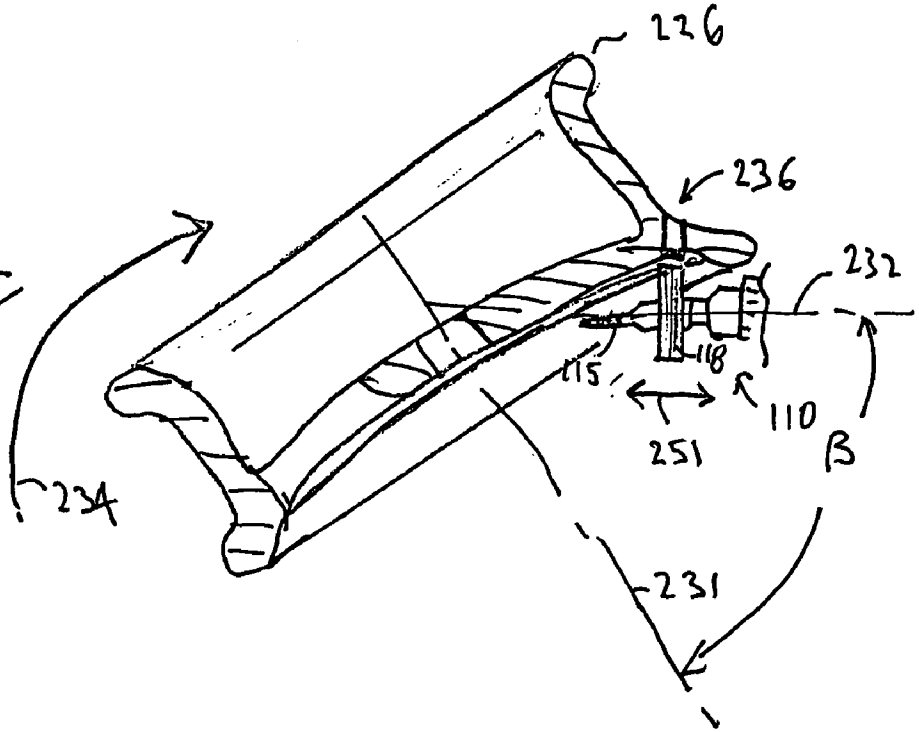
FIG. 6*b* is an illustration of another portion of the method illustrated in FIG. 5.
Figure 6A:
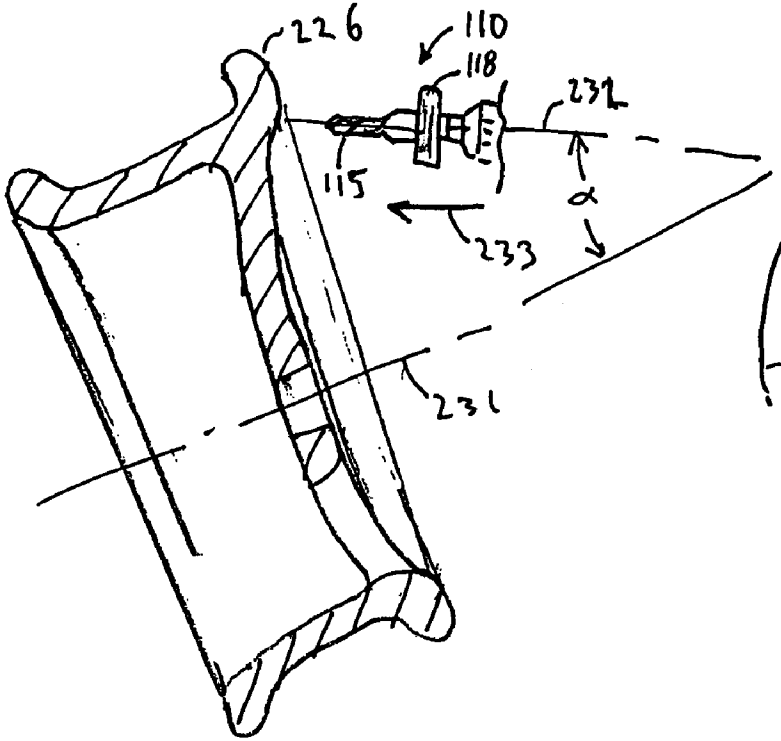
FIG. 6*a* is an illustration of a portion of the method illustrated in FIG. 5.

In functional block 230, the wheel is positioned by the clamping mechanism relative to the drill head for machining. For machining a valve stem hole in the wheel, the wheel is oriented such that the wheel axis 231 forms a first angle, a, relative to the tool axis 232, as shown in FIG. 6*a*. This allows drilling the valve stem hole through the wheel sidewall at an angle to the wheel axis 231. Preferably, the wheel positioning is controlled by a preset program stored within the CNC machine. For drilling other apertures, the wheel 226 may be oriented with the wheel axis 231 parallel to the tool axis, as will be described below. The method 210 then proceeds to functional block 235.

In functional block 235, the wheel 226 is drilled by rotating and advancing the tool 110 toward the wheel to form the valve stem hole 236 through the wheel sidewall. The motion of the tool 110 is illustrated by the arrow labeled 233 in FIG. 6*a*. Preferably, the machining is controlled by the program stored within the CNC machine. The method 210 then proceeds to functional block 240.

In functional block 240, the tool 110 is withdrawn from the valve stem hole 236 under control of the machine program. For simplicity, the valve stem hole 236 is shown in FIGS. 6*a* and 6*b* as a simple bore. This is meant to be exemplary since a typical valve stem hole would include counterbored and countersunk portions (not shown) that would require cutting with additional tools. For such actual holes, the appropriate tool would be indexed into position and applied before continuing to functional block 245.

In functional block 245, the wheel 226 is reoriented by the clamping mechanism with the wheel axis 231 forming a second angle, β, relative to the tool axis 232, as illustrated in FIG. 6*b*. The angle β is selected such that the drill bit end of the tool 110 will clear the surface of the wheel during the deburring operation described below. As shown in FIGS. 6*a* and 6*b*, the sum of α and β is approximately 90 degrees, however, the sum of the angles can be less than 90 degrees. The motion of the clamping mechanism is illustrated by the single headed arrow that is labeled 234 in FIG. 6*b*. The reorientation of the wheel 226 presents the edge of outer end of the valve stem hole 236 to the outer edge of the abrasive wheel 118 included with the tool 110. The method 210 then proceeds to functional block 250.

In functional block 250, the tool 110 is rotated while being advanced toward and retracted from the wheel 226, as illustrated by the double headed arrow labeled 251 in FIG. 6*b*. The outer edge of the abrasive wheel 118 contacts the outer end of the valve stem hole 236 and removes any burrs from the edge of the hole by the abrasive action of the wheel bristles.

Figure 7:
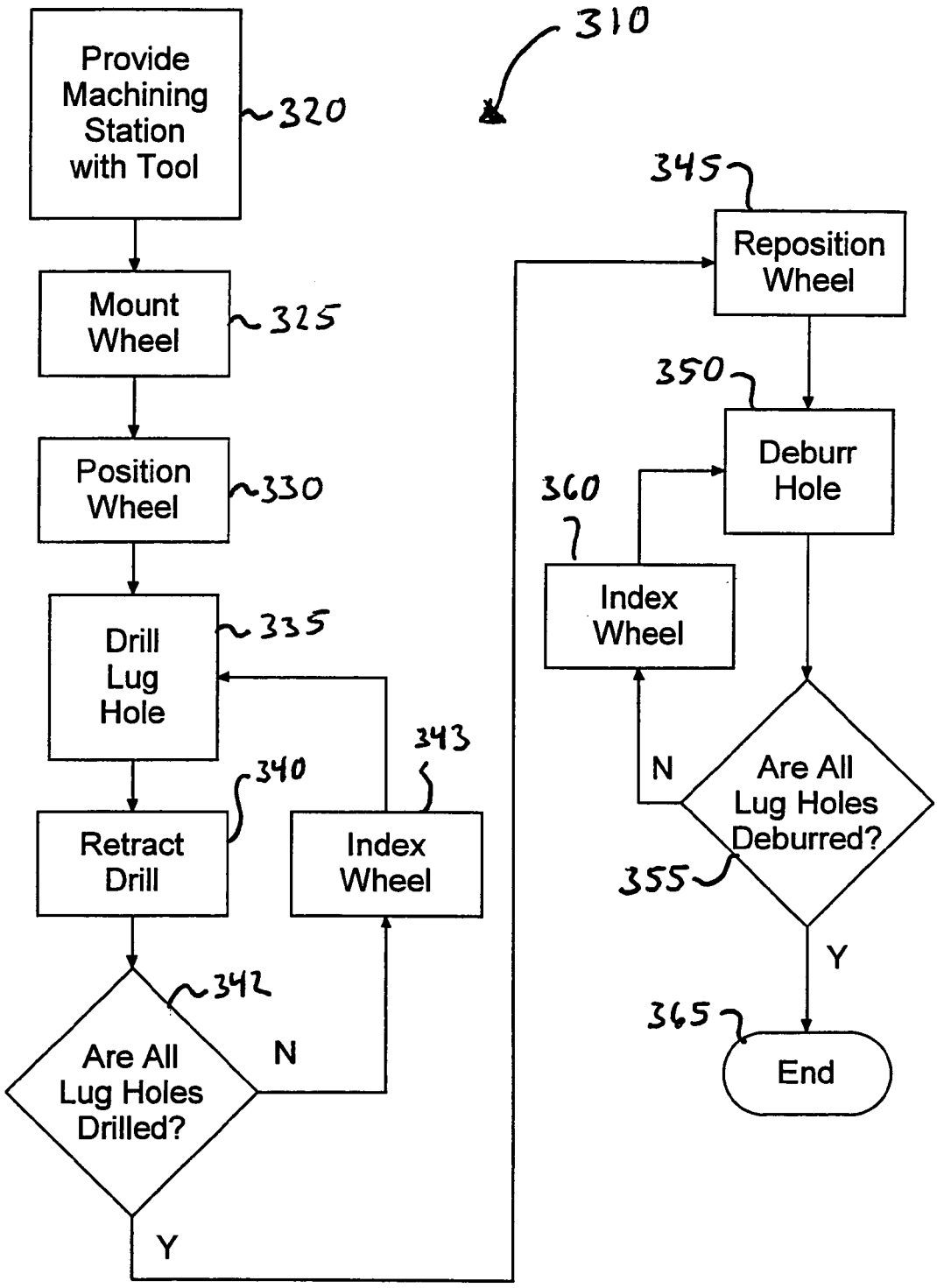
FIG. 7 is a flow chart illustrating an alternative embodiment of the method shown in FIG. 5.

The present invention further contemplates a method 310 that may be used for machining and deburring the lug holes of a vehicle wheel with a tool that is accordance with the present invention. The method 310 is illustrated by the flow chart shown in FIG. 7.

Figure 8B:
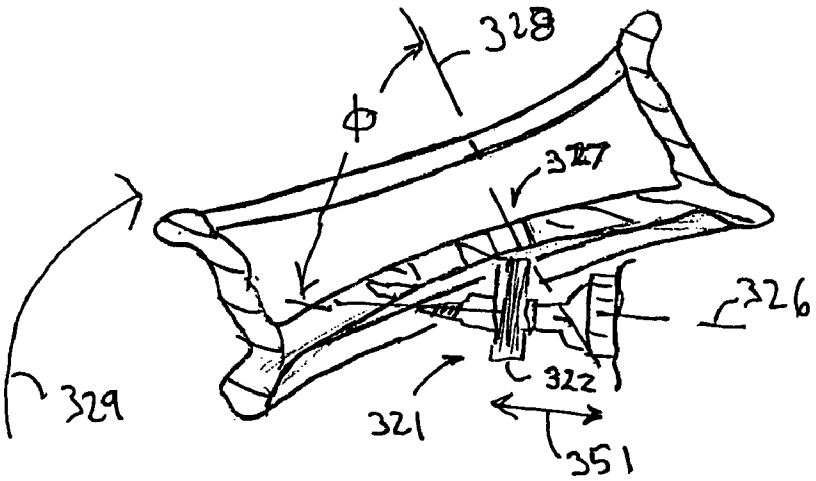
FIG. 8*b* is an illustration of another portion of the method illustrated in FIG. 7.
Figure 8A:
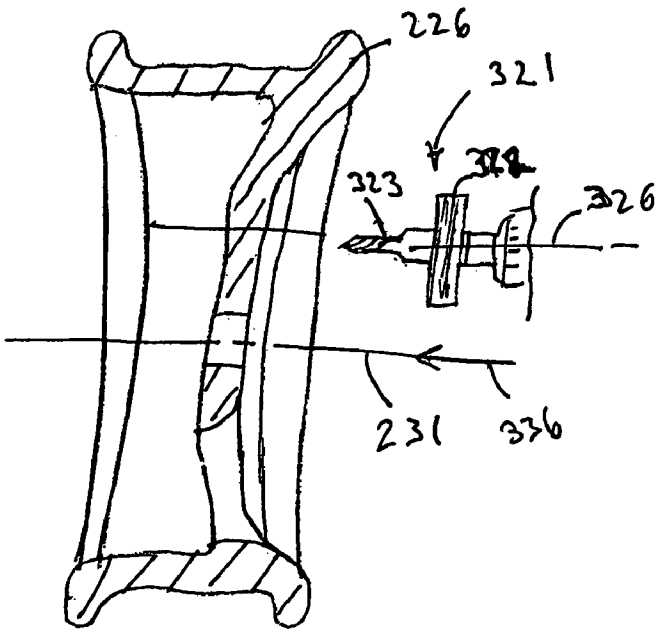
FIG. 8*a* is an illustration of a portion of the method illustrated in FIG. 7.

The method 310 begins in functional block 320 with provision of a machining station for drilling lug holes through a vehicle wheel hub. The machining station typically includes an automated drill head carrying multiple tools, as needed. One of the tools is a lug hole forming tool 321 that is illustrated in FIGS. 8*a* and 8*b*, where components that are similar to components shown in FIGS. 6*a* and 6*b* have the same numerical identifiers. The lug hole tool 321 includes an abrasive wheel 322 mounted upon a lug hole drill bit 323, similar to the tool 110 described above. Preferably, the machining station is a Computer Numerical Control (CNC) machining station. The method 310 then proceeds to functional block 325 where a wheel 226 is mounted upon the machining station clamping mechanism (not shown) with the outboard wheel surface facing the automated drill head and the wheel axis 231 parallel to the tool axis 326. The method 210 then proceeds to functional block 330.

In functional block 330, the wheel 226 is positioned for drilling a first lug hole which requires offsetting the wheel axis 231 relative to the lug hole tool axis 326, as illustrated in FIG. 8*a*. The method then proceeds to functional block 335, where a lug hole 327 is drilled through the wheel hub. The lug hole 327 is drilled by advancing the tool toward the wheel 226, the motion of which as illustrated by the arrow labeled 336 in FIG. 8*a*. Preferably, the drilling is controlled by programming the CNC machine. The method 310 then proceeds to functional block 340.

In functional block 340, the tool for machining the wheel is withdrawn. Preferably, the withdrawal is controlled by programming the CNC machine. The method 310 then proceeds to decision block 342, where it is determined if all of the lug holes to be formed in the vehicle wheel have been drilled. If not all of the lug holes to be formed in the vehicle wheel have been drilled then the method 310 proceeds to functional block 343.

In functional block 343, the wheel 226 is indexed by a rotation of the clamping mechanism to align the wheel 226 with the lug hole tool 321 for drilling the next lug hole. Once the wheel 226 has been indexed the method 310 returns to functional block 335 and continues as before to drill another lug hole.

If it is determined in decision block 342 that all of the lug holes have been drilled, then the method 310 proceeds to functional block 345. In functional block 345, the wheel is repositioned relative to the lug hole tool 321 by the clamping mechanism with the axis of the tool 326 forming an angle, ϕ, with the axis 328 of the lug hole 327. The angle ϕ is selected to bring the outer edge of the abrasive wheel 322 into contact with the outer end of a hole as the tool 321 is advanced toward the wheel 226, but without the cutting end of the tool 326 contacting the wheel surface. The motion of wheel as it is repositioned is illustrated by the single headed arrow labeled 329 in FIG. 8*b*. The method 310 then proceeds to functional block 350.

In functional block 350, burrs are removed from the end of the lug hole by the rotation of abrasive wheel 322 mounted upon the tool 321 as the tool is advanced toward the wheel 226. The motion of the tool 321 is illustrated by the double headed arrow labeled 351 in FIG. 8*b*. The method 310 then proceeds to decision block 355.

In decision block 355, it is determined if all of the lug holes have been deburred. If not all of the lug holes formed in the vehicle wheel have been deburred then the method 310 transfers to functional block 360 where the wheel 226 is indexed to align another lug hole with the tool 321. Once the wheel has been indexed, the method 310 returns to functional block 350 and proceeds to deburr the lug hole.

If it is determined in decision block 355 that all of the lug holes have been deburred, the method 310 transfers to terminal exit block 365 where the method 310 ends. While the method has been described as drilling all of the lug holes before deburring the lug holes, it will be appreciated that the method also may be practiced with drilling and deburring each hole before indexing the wheel (not shown).

Figure 9:
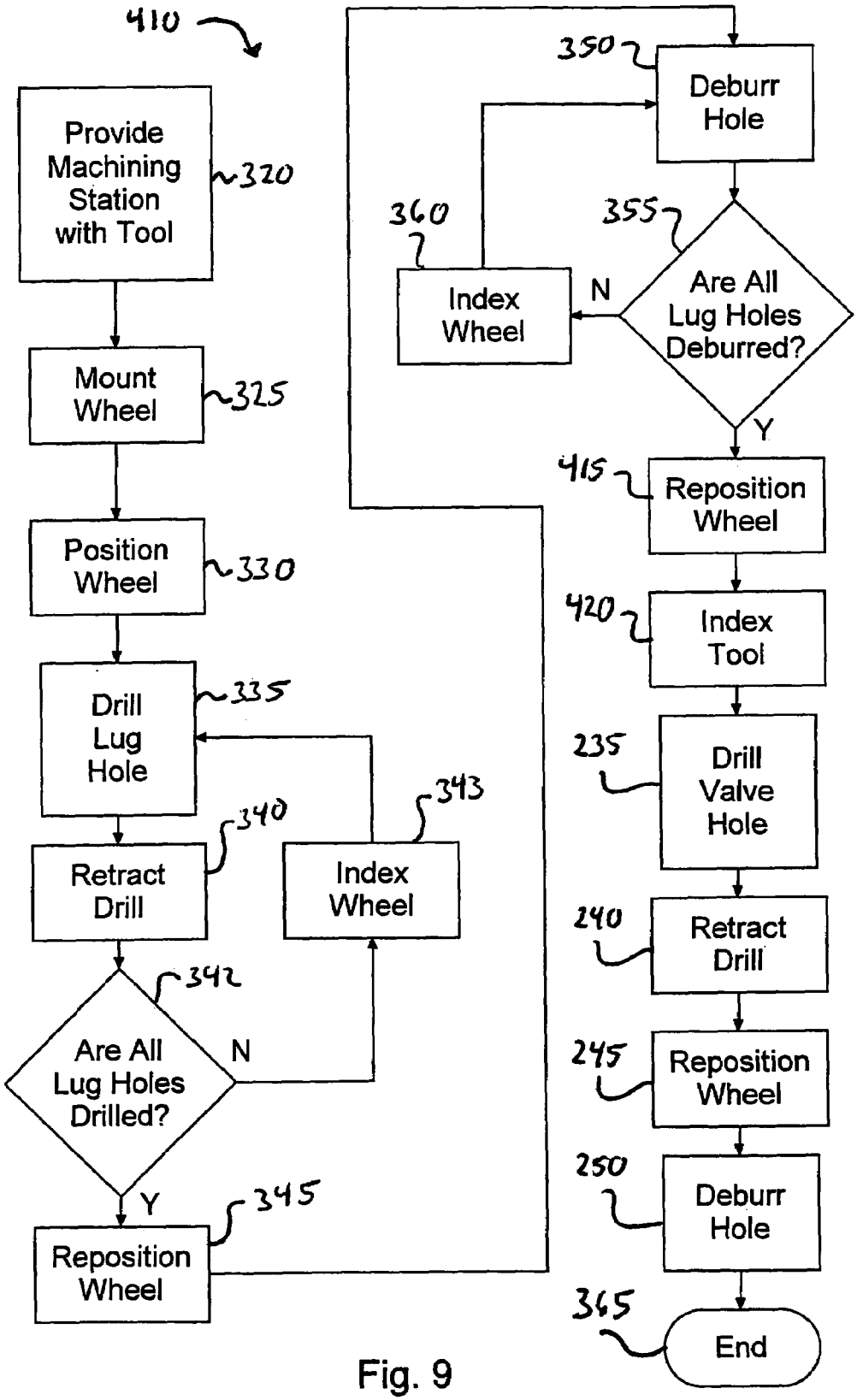
FIG. 9 is a flow chart illustrating another alternative embodiment of the method shown in FIG. 5.

The present invention additionally contemplates a combined method for machining and deburring both the valve stem hole and the lug holes of a vehicle wheel. The method is shown by the flow chart shown in FIG. 9, where blocks that are similar to blocks shown in the preceding flow charts have the same numerical identifiers. As shown in FIG. 9, the method first drills and deburrs the lug holes as illustrated by the method 310 shown in FIG. 7. Upon completion of the deburring of the lug holes, the method 410 advances to functional block 415 where the wheel is repositioned for drilling a valve stem hole, as shown in FIG. 6*a*. Then the tool head is indexed in functional block 420 to align the valve stem hole tool with the wheel. The method then continues to machine and deburr a valve stem hole as described above and illustrated in FIG. 5.

While the method 410 is illustrated in FIG. 9 with the wheel being repositioned in functional block 415 before indexing of the tool head, it will be appreciated that the tool head may be indexed before the wheel is repositioned (not shown). Additionally, the method also may be practiced with the machining and deburring of the valve stem hole preceding the drilling and deburring of the lug holes (not shown). Furthermore, while the method 410 is illustrated as utilizing a lug hole tool 321 that includes an abrasive wheel 322 and a valve stem hole tool 110 that also includes an abrasive wheel 118, it also will be appreciated that the abrasive wheel on one of the tools may be used to deburr all of the holes (not shown). Thus, if the abrasive wheel 118 included in the valve stem hole tool 110 is used to debur the ends of the lug holes, only a lug hole drill bit (not shown) would be needed to be mounted upon the tool head. However, if one tool is used to deburr all of the hole ends, additional wheel orienting steps would be included in the flow chart shown in FIG. 9.

It will be appreciated that the flow charts described above and illustrated in FIGS. 5, 7 and 9 are meant to be exemplary and that the invention also may be practiced with variations from the flow charts shown.

The present invention provides a consistent method for deburring valve stem holes, increases the overall quality of deburred valve stem holes as compared to known methods and reduces the time needed to debur valve stem holes compared to known methods. Accordingly, the inventors believe that the deburring tool and method of using the tool will substantially decrease the manufacturing costs of vehicle wheels.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A device for forming a recess in a surface of forming an aperture through a vehicle wheel, the device comprising:

a head for carrying at least one tool;

a rotatable cutting tool having a shank, said rotatable cutting tool being carried by said head;

an abrasive wheel disc having an outer abrasive circumferential surface, said abrasive wheel disc being mounted upon said shank of said rotatable cutting tool; and a clamping mechanism adapted to hold a vehicle wheel, at least one of said clamping mechanism and said tool head being movable to orient the vehicle wheel and said cutting tool relative to one another in a first position such that said cutting tool can cut a recess into a surface of the vehicle wheel and further being movable to orient the vehicle wheel and said cutting tool relative to one another in a second position such that said abrasive wheel disc can debur the edge of said recess.

2. The device of claim 1 wherein said abrasive wheel is removeably mounted upon said rotating tool.

3. The device of claim 1 wherein said abrasive wheel is permanently secured upon said rotating tool.

4. The device of claim 2 wherein said abrasive wheel includes a central collar having an axially extending bore formed therethrough, said bore receiving said rotating tool.

5. The device of claim 4 further including a fastener carried by said collar, said fastener securing said abrasive wheel to said rotating tool.

6. The device of claim 5 wherein said fastener has a threaded aperture formed therethrough and further wherein said fastener is threaded, said threaded fastener being received by said collar aperture and extending therefrom against said rotating tool to secure said abrasive wheel upon said rotating tool.

7. The device of claim 5 wherein said abrasive wheel includes a plurality of radially extending wire bristles.

8. The device of claim 5 wherein said abrasive wheel is formed from an abrasive stone material.

9. The device of claim 6 wherein said threaded fastener is a set screw.

10. The device of claim 7 wherein said rotating tool is a drill bit.

11. The device of claim 7 wherein said rotating tool is a counterbore.

12. The device of claim 7 wherein said rotating tool is a countersink.

13. A method for machining a vehicle wheel, the method comprising:

(a) providing a tool for machining and deburring a recess into a vehicle wheel, the tool including a rotatable cutting portion extending axially from a shank portion, the tool further including an abrasive wheel disc mounted upon the shank portion;

(b) mounting the tool upon a vehicle wheel machining station;

(c) mounting a vehicle wheel upon the vehicle wheel machining station;

(d) moving at least one of the mounted vehicle wheel and the tool relative to one another to position the rotatable cutting portion of the tool adjacent to the vehicle wheel;

(e) rotating and advancing the cutting portion of the tool toward the vehicle wheel to cut the recess into the vehicle wheel;

(f) moving at least one of the mounted wheel and the tool relative to one another to position the abrasive wheel disc adjacent to the recess cut in step (e); and (g) rotating and advancing the abrasive wheel disc against the vehicle wheel to debur the edge of the recess.

14. The method according to claim 13 wherein step (e) includes, subsequent to cutting the recess, retracting the tool.

15. The method according to claim 14, wherein step (g) includes, subsequent to deburring the edge of the recess, retracting the tool.

16. The method according to claim 15 wherein the abrasive wheel disc is a wire brush wheel.

17. The method according to claim 15 wherein the tool provided in step (a) includes a drill bit having a cutting portion and a shank portion with an abrasive wheel disc mounted upon the shank portion of the drill bit and further wherein during step (e) an aperture is drilled through the vehicle wheel with the drill bit and further wherein during step (g) an end of the aperture is deburred.

18. The method according to claim 17 wherein the drilled aperture is one of a plurality of lug holes drilled through the vehicle wheel and deburred with th tool provided in step (a).

19. The method according to claim 15 wherein the tool is a countersink having a cutting portion and a shank portion with an abrasive wheel disc mounted upon the shank portion of the countersink and further wherein step (e) includes countersinking an end of a previously drilled aperture and step (g) includes deburring the edge of the countersunk portion of the aperture.

20. The method according to claim 15 wherein the tool is a counterbore having a cutting portion and a shank portion with an abrasive wheel disc mounted upon the shank portion of the counterbore and further wherein step (e) includes counterboring an end portion of a previously drilled aperture and step (g) includes deburring the edge of the countersunk portion of the aperture.

21. The method according to claim 20 wherein the recess is a valve stem hole formed through a sidewall of the wheel.

22. The method according to claim 15 wherein the vehicle wheel machining station provided in step (b) includes a tool head carrying a plurality of tools that includes the tool provided in step (a) and the recess machined in step (e) is a first recess, and further wherein, following step (g), the tool head is indexed and at least one of the mounted vehicle wheel and the tool head are reoriented following which steps (e) through (g) are repeated to machine and deburr a second recess into the vehicle wheel.

* * * * *

UNITED STATES PATENT AND TRADEMARK OFFICE

CERTIFICATE OF CORRECTION

PATENT NO. : 6,926,593 B1
DATED : August 9, 2005
INVENTOR(S) : Jeremy Carroll et al.

It is certified that error appears in the above-identified patent and that said Letters Patent is hereby corrected as shown below:

Column 8,
Line 39, delete “th” and insert -- the --.

Signed and Sealed this

Twenty-seventh Day of September, 2005

JON W. DUDAS
*Director of the United States Patent and Trademark Office*